US007347775B2

(12) United States Patent
Roemer

(10) Patent No.: US 7,347,775 B2
(45) Date of Patent: Mar. 25, 2008

(54) GAMING MACHINES WITH COMMUNICATION LINKS CONFIGURED TO PRESENT BONUS GAMES

(76) Inventor: Mickey Roemer, 204 Surtees Point, Las Vegas, NV (US) 89144

( * ) Notice: Subject to any disclaimer, the term of this patent is extended or adjusted under 35 U.S.C. 154(b) by 301 days.

(21) Appl. No.: 10/899,669

(22) Filed: Jul. 26, 2004

(65) Prior Publication Data

US 2006/0019734 A1 Jan. 26, 2006

(51) Int. Cl.
*A63F 9/24* (2006.01)

(52) U.S. Cl. ..... 463/16; 463/25

(58) Field of Classification Search ..... 463/16–22, 463/40–42; 273/138.1, 139
See application file for complete search history.

(56) References Cited

U.S. PATENT DOCUMENTS 5,848,932 A * 12/1998 Adams ..... 463/20
5,971,271 A 10/1999 Wynn et al.
6,012,983 A 1/2000 Walker et al.
6,146,276 A 11/2000 Okuniewicz
6,206,782 B1 3/2001 Walker et al.
6,312,332 B1 * 11/2001 Walker et al. ..... 463/23
6,413,160 B1 7/2002 Vancura
6,419,583 B1 7/2002 Crumby et al.
6,530,835 B1 3/2003 Walker et al.
6,575,829 B2 6/2003 Coleman et al.
6,634,942 B2 10/2003 Walker et al.
6,682,421 B1 1/2004 Rowe et al.
6,690,779 B2 2/2004 Walker et al.
6,712,702 B2 3/2004 Goldberg et al.
6,752,717 B2 6/2004 Vancura
6,837,793 B2 1/2005 McClintic
2003/0027635 A1 2/2003 Walker et al.
2003/0045358 A1 3/2003 Leen et al.
2003/0060258 A1 * 3/2003 Coleman et al. ..... 463/16
2003/0062680 A1 * 4/2003 Seelig et al. ..... 273/292
2003/0092485 A1 5/2003 Seelig et al.
2003/0114218 A1 * 6/2003 McClintic ..... 463/25
2003/0114219 A1 * 6/2003 McClintic ..... 463/25
2003/0139190 A1 7/2003 Steelberg et al.
2003/0176213 A1 9/2003 LeMay et al.
2004/0030654 A1 2/2004 Walker et al.
2004/0235554 A1 * 11/2004 DeFrees-Parrott et al. .... 463/17

FOREIGN PATENT DOCUMENTS

GB 002373138 A 9/2002
JP 02003024642 A 1/2003

* cited by examiner

*Primary Examiner*—Robert E. Pezzuto
*Assistant Examiner*—Alex F. R. P. Rada, II
(74) *Attorney, Agent, or Firm*—Weide & Miller, Ltd.

(57) ABSTRACT

Gaming machines include telecommunication devices, such as telephones, so that calls may be placed to the player of the machine and/or so that calls may be placed from the machine to a remote location. A game includes the opportunity to involve a third party participant located remote from the gaming machine, in the play of the game via a telecommunication link. In one embodiment, a game includes a base game having the opportunity for one or more bonus or secondary events. One event includes the opportunity to call a participant, with the player and participant provided the opportunity to play a game for winnings, such as money, prizes or points. Another event involves calls to the player as part of an opportunity of the player to win winnings, such as money, prizes or points.

27 Claims, 5 Drawing Sheets

GAMING MACHINES WITH COMMUNICATION LINKS CONFIGURED TO PRESENT BONUS GAMES

FIELD OF THE INVENTION

The present invention relates to gaming machines and methods of playing games.

BACKGROUND OF THE INVENTION

Gaming continues to grow in popularity and is spreading geographically and demographically. As gaming grows, so does the player's desire for new and exciting games.

A variety of games have been developed recently which include new features designed to add excitement to the game play. These games and gaming machines suffer from a number of drawbacks.

First, a number of games presently offer "bonus" events. These events, however, are generally very static events which are not very exciting. For example, in the play of some slot-type games, if the player receives a certain combination of symbols, a circular wheel printed with bonus values may spin and stop, yielding the player with a bonus pay. These types of bonus events have become commonplace, and do not include any player participation.

Second, most machine-presented casino games suffer from the problem that they are single player games. Thus, some players like to play games such as poker and bingo where multiple players are involved. Otherwise, when playing a gaming machine, the game play experience is very isolated.

The present invention is a gaming machine, system and method of game play which has numerous advantages over the prior art games and gaming devices.

SUMMARY OF THE INVENTION

The invention comprises methods of playing/presenting one or more games, gaming machines for presenting games, and gaming systems including gaming machines. Preferably, the games are played as wager type games, with the opportunity for monetary awards for winning results.

In one embodiment, a gaming machine includes a telecommunication device, such as a telephone, so that calls may be placed to the player of the machine and/or so that calls may be placed from the machine to a remote location. In a preferred embodiment, the telecommunication device is activated when one or more outcomes are received while playing a game presented by the gaming machine. Various bonus games or event include the use of the telecommunication device.

In one embodiment, a method of playing a game includes the opportunity to involve a third party participant located remote from the gaming machine in the play of the game via a telecommunication link. In one embodiment, a game includes presenting a base game having the opportunity for one or more bonus games or events. One event includes the opportunity to call a third party participant, with the player and participant provided the opportunity to play a bonus event for winnings.

In one embodiment, upon receiving abonus initiating event as part of play of the base game, the player is permitted to attempt to call a third party of their choice to participate in a bonus game. If the player's call is successful, the player and third party play for the opportunity to win an award, such as a monetary payout. In another embodiment, a telephone number is dialed at random, or is selected from a database of willing participants.

Additional methods of play include the opportunity to participate in bonus games including the play of one or more games for the opportunity for additional winnings. Various additional embodiments of the invention comprise the use of the telecommunication device to establish bonus event criteria, such as the size of a bonus multiplier. In one embodiment, the number of audible rings before a player answers the telecommunication device establishes the size of a multiplier or other value.

One embodiment of the invention is a system including one or more servers and one or more gaming machines. The servers store participant information, and preferably, telephone numbers of parties who are willing to participate in the bonus events of the games of the invention. The telephone number information is used to call participants of the various bonus events.

Further objects, features, and advantages of the present invention over the prior art will become apparent from the detailed description of the drawings which follows, when considered with the attached figures.

DETAILED DESCRIPTION OF THE INVENTION

The invention includes gaming devices, systems including one or more gaming devices, and methods of playing a game. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises gaming machines configured to present a game, one or more games or events, and one or more systems including gaming machines and data. Preferably, gaming machines include a telecommunication device, allowing calls to be placed to the player of a game and/or to a third-party participant located remote from the gaming machine.

One embodiment of the invention is a method of presenting and/or playing a game. Preferably, the game is presented on or by a gaming machine. One embodiment of the invention is a gaming machine which is particularly configured to present the game(s) of the invention.

Figure 1:
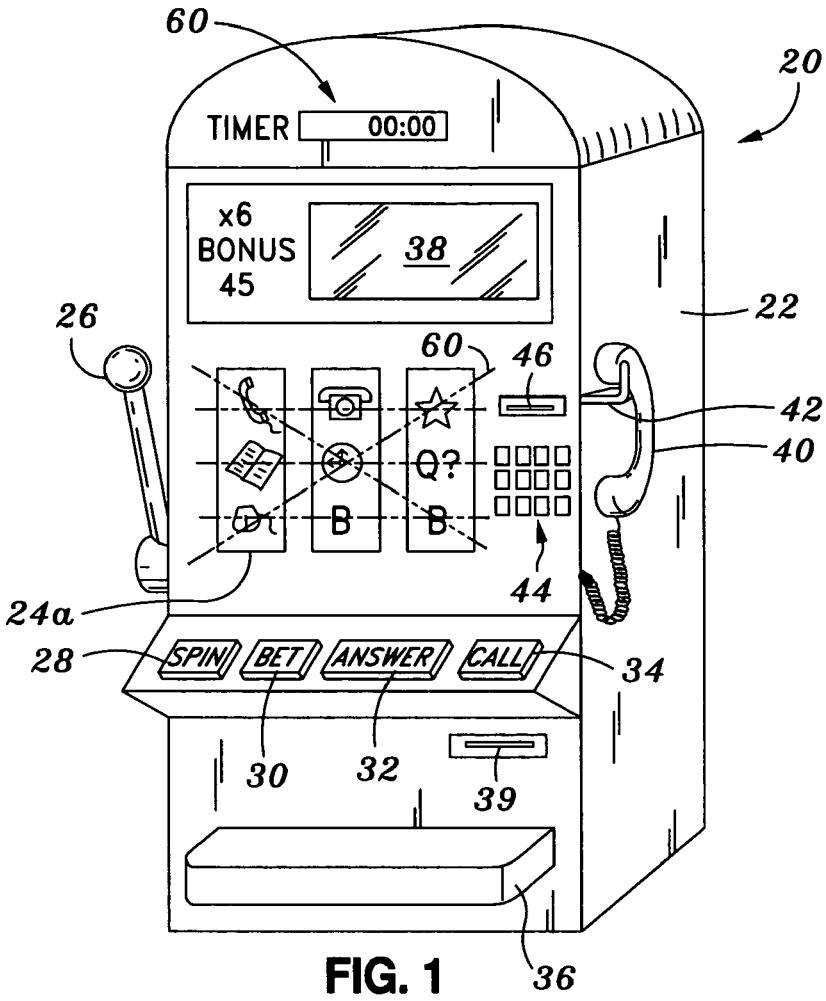
FIG. 1 is a perspective view of a gaming machine in accordance with one embodiment of the invention.

Referring to FIG. 1, a gaming device or machine of the 20 of the includes a housing of the 22 of the containing or supporting various components. The gaming machine or device 20 is, either alone or in combination with other devices, preferably configured to present a game, such as a game of the invention. It will be appreciated that the housing 22 may have a variety of shapes and configurations. For example, the gaming machine 20 may be configured as an "upright", "bar-top" or "slant" style gaming machine, which configurations are well known in the industry.

As illustrated, the gaming machine 20 includes means for displaying symbols or indicia utilized in the play or presentation of a game. In a preferred embodiment, the gaming machine 20 includes three mechanical reels 24*a,b,c*. In a preferred embodiment, the reels 24*a,b,c* are utilized to present or play a base or main game or event, and as such are referred to generally herein as "main game" reels.

Such reels 24*a,b,c* are well known, and comprise a body having one or more indicia or symbols printed thereon. Thee reels 24*a,b,c* may have a number of positions or locations which bear or do not bear (i.e. comprise a "blank" position) indicia. The indicia or symbols which are borne by the reels 24*a,b,c* may vary. Preferred examples of symbols for use in playing games of the invention are described in detail below.

The various combinations of indicia displayed by the reels 24*a,b,c* preferably have significance to or relate to the outcome of a game presented at the machine 20. For example, certain combinations of indicia may comprise a non-winning combination. Preferably, one or more combinations of the indicia when displayed as a result of a spin of the reels 24*a,b,c* are designated as a winning combination of indicia The number of winning combinations may vary dependent upon the desired payout or winning percentage to the players as compared to that which is retained by the game operator. In one or more embodiments, at least one of the same indicia is contained on each of the reels 24*a,b,c*, and at least one winning combination comprises all of the reels 24*a,b,c* displaying that same indicia.

Means are provided for rotating the reels 24*a,b,c*. In one or more embodiments, the means may comprise a mechanical linkage associated with a spin arm 26, with movement of the spin arm (a "pull") by a user causing the reels 24*a,b,c* to spin. In such an arrangement, the reels 24*a,b,c* are generally allowed to free-wheel and then stop. In another embodiment, electronically controlled mechanisms are arranged to rotate and stop each reel 24*a,b,c*. Such mechanisms are well known to those of skill in the art. In this arrangement, actuation of the spin arm 26 or depression of a spin button 28 causes a controller (not shown) to signal the activation of the spin mechanism associated with one or more of the reels of the 24*a,b,c*. Preferably, the controller is arranged to either turn off the signal to the device(s) effecting the rotation of each or all of the reels 24*a,b,c*, or generates a signal for activating a braking device, whereby the reels 24*a,b,c* are stopped. As is well known, the combinations of reel positions and their odds of hitting are associated with the controller, and the controller is arranged to stop the reels 24*a,b,c*, in a position displaying a combination of indicia as determined by the controller based on the combinations and odds. The principal of such an arrangement is described in U.S. Pat. No. 4,448,419 to Telnaes, which is incorporated herein by reference.

The gaming machine 20 preferably includes one or more player inputs which permit the player to interact with the gaming machine 20. In the embodiment illustrated, the gaming machine 20 includes a plurality of push-buttons. As described above, one such button may comprise a "spin" button 28. As also illustrated, buttons or similar input devices may include a "bet" button 30, "answer" button 32, and "call" button 34.

A wide variety of other inputs maybe provided, varying both in form and function. For example, in one embodiment, one input may comprise a "touch screen" type display. Other inputs, such as rotatable arms, joysticks, keyboards or keypads, or other inputs maybe provided. Each input preferably provides input, such as by way of an electrical signal, to the gaming controller or other game content generating device. In that manner, game play is interactive.

In one embodiment, the gaming machine 20 is configured to present a game only upon a player placing a bet, wager, or other payment. Thus, the gaming machine 20 may include means for accepting value, and preferably, monetary value. As illustrated, the gaming machine 20 may include a coin acceptor (not shown). The coin acceptor maybe configured to accept coins of one or more denominations. A coin sorter, coin hopper and other coin holding and processing devices maybe located in the housing 22 of the gaming machine 20.

The gaming machine 20 may also or alternatively include a bill validator (not shown). The bill validator may be configured to accept paper money of one or more denominations. A bill stacker and other bill processing and storage devices may be located in the housing of the 22 of the of the gaming machine 20.

The gaming machine 20 may also or alternatively include a ticket reader, smart card, credit card or other media acceptor/reader. Such devices maybe utilized to obtain information regarding value, such as credit card account information or bar-coded ticket value.

When value is provided to the gaming machine 20, the gaming machine 20 maybe configured to display information regarding the provided value, such as in the form of "credit" information. This information maybe displayed, for example, on a display of the gaming machine or one associated therewith.

The player may utilize inputs to place a wager, bet or provide payment to play a game. For example, a player may depress the "bet" button 30 to bet or wager one or more credits.

In one embodiment, the gaming machine 20 is configured to award winnings for winning outcomes of games played. The winnings may be paid or provided to the player in a variety of manners. In one embodiment, awards may be indicated in the form of credits. Thus, when a player wins, the total number of credits belonging to them is increased, and the increased amount may be displayed to the player. The player may utilize the awarded credits to play future games.

In another embodiment, the player maybe awarded money, or may convert credits to money. As illustrated, the gaming machine 20 may include a coin tray 36 into which coins maybe dispensed. The coins may represent a specific award. Alternatively, the player may utilize a "cash out" button or input (not shown) and be paid the value of their credits in the form of coins.

Other forms of payment may be provided, such as by issuance of a ticket which represents value. As illustrated, the gaming machine 20 includes a ticket printer 39 for printing and dispensing a medium bearing information regarding value.

Non-monetary prizes may also be awarded. For example, credits maybe redeemed for prizes or a ticket or tickets maybe redeemed for specific prizes or general prizes. In other embodiments, game play may be for entertainment purposes only and no prize or award may be won or awarded. In one embodiment, a player may win points which the player can accrue and use, such as for free game play. In another embodiment, no payment need be provided. For example, the game may be played for recreational purposes only. In other embodiments, points maybe awarded, the points having no "value," except to provide the player an indication of the level of success of play of the game. Such a level of points may be compared, for example, to the level of points achieved by other players.

It will be appreciated that instead of mechanical reels 24*a,b,c*, other means maybe utilized to display symbols, indicia or other information regarding play of the main game. For example, such indicia could be displayed by a video display. The display may be of a variety of types now known or later developed, such as DLP, CRT, plasma, LCD or others.

In a preferred embodiment of the invention, the gaming machine 20 includes a second means for displaying symbols or indicia In one embodiment, this means comprises a video display 38. As described above, such a display maybe of a variety of types now known or later developed. In general, the display 38 is configured to present information for viewing by a player of the gaming machine 20. The second means might also include additional reels.

Preferably, means are provided for controlling the operation of the gaming machine 20, such as the reels 24*a,b,c* and the display 38. In one embodiment, that means comprises a gaming controller. The gaming controller maybe configured to track game credits (including value provided to the gaming machine and bets placed), initiate the rotation and stopping the reels 24*a,b,c*, and, as detailed below, initiate bonus events including generating information for display by the display 38. In one embodiment, a gaming controller includes a processor and a memory. The memory stores software which is executed by the processor. In one embodiment, the gaming controller is located inside of the housing 22 of the gaming machine 20.

In another embodiment, the operation of the gaming machine 20 maybe controlled in whole or in part from a remote location, such as a remote server. For example, game data may be generated remotely and be transmitted to the gaming machine 20 for display. The game data may then be downloaded to the gaming machine 20 via a wired or wireless communication link.

In one embodiment, the gaming machine 20 includes a telecommunication device comprising a transceiver and a handset 40. Preferably, the handset 40 includes a microphone configured to accept audio input from the player and a speaker for presenting audio output to a player. The handset 40 may be of a variety of forms. As illustrated, it comprises a physical element. In other embodiments, it may comprise one or elements of the gaming machine 20 and be integrated into the machine. For example, the speaker may comprise a speaker which is used to generate other audio information at the gaming machine.

As is known in the art of telephones, in an embodiment where the handset 40 is a physical device, the handset 40 may be mounted on an actuatable hook 42. Removal of the handset 40 from the hook 42 may close a circuit, thus establishing a communication link to the handset 40 (as in the case of an incoming call) or establish a link with a remote location (as in the case of an outgoing call). As illustrated, "answer" and "call" buttons 32,34 maybe utilized for similar purposes. The use of the handset 40 or buttons 32,34 is described in more detail below.

The telecommunication device may have other forms. For example, the speaker and receiver of the handset may be built into the machine itself. The device might also include a wireless handset.

In one embodiment, the gaming machine 20 also includes an input in the form of a keypad 44. The keypad 44 is configured to accept input from a player, such as numbers, letters or a combination thereof. In one embodiment, the keypad 44 permits the input of the numbers 1, 2, 3, 4, 5, 6, 7, 8, 9, and 0, as well as the symbols # and *, in similar fashion to the keypad of a touch-type telephone.

This same keypad 44 may be associated with a card reader 46, such as a card reader of a player tracking system. As is well known, in such a system, a player may identify themselves (such as by input of a card bearing information). Awards may be provided to the player associated with their play.

The gaming machine 20 illustrated and described is just one embodiment of a device which may be used to present a game in accordance with the invention. Other devices maybe utilized. For example, the gaming machine 20 may also comprise a computing device, such as a laptop or desktop computer. Game information maybe transmitted via a communication link to a remote player. The communication link may include, for example, the Internet. The game information maybe utilized by the remote player's computer, such as by displaying game information on an associated screen. A player may provide input via a keyboard, mouse or other input device.

Various aspects of the games of the invention may be presented at other than a gaming machine. For example, as described below, various features of the invention maybe implemented in conjunction with a table game.

Figure 2:
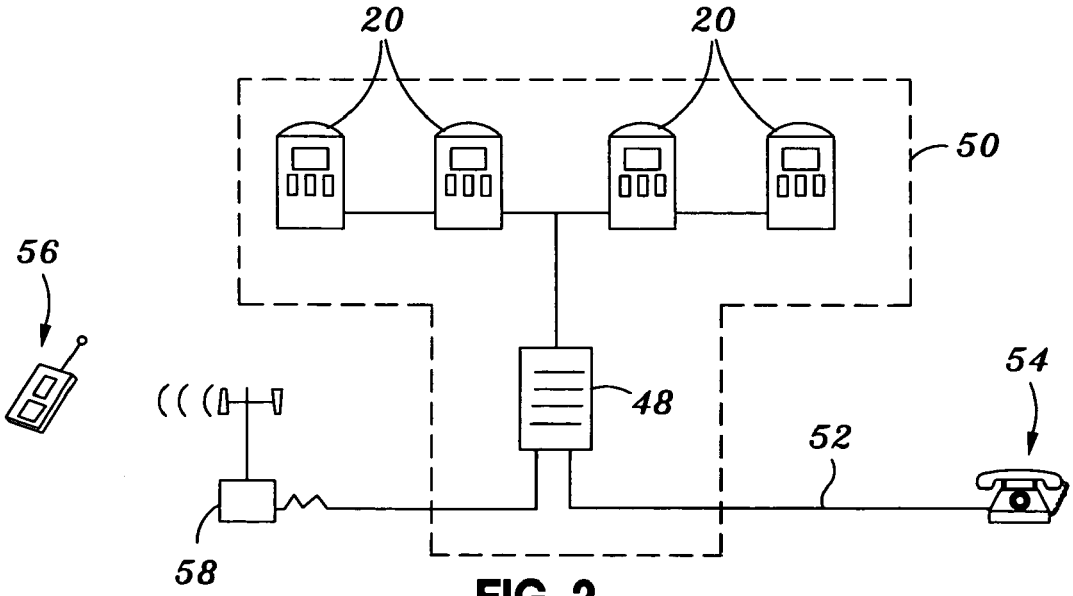
FIG. 2 is a diagram illustrating one embodiment of a gaming system in accordance with an embodiment of the invention.

Preferably, the gaming machine 20 is configured to establish a telecommunication link to the player of the game and/or from the player at the gaming machine to a remote location. In one embodiment, a telecommunication link maybe established directly to the gaming machine 20 from a remote location, such as a telephone exchange, in similar fashion to a telephone in a home. Referring to FIG. 2, in one embodiment, a plurality of gaming machines 20 are all associated with one or more common devices.

In one embodiment, a telecommunication link exists between the gaming machine 20 and a central location, such as server 48. The gaming machines 20 and server 48 may comprise a gaming system 50, such as operated by a casino.

The server 50 may have a variety of configurations and may comprise a single device or a group of devices. In one embodiment, the server 50 comprises a computing device including a processor, a memory for storing data, and at least one transceiver. The transceiver comprises a communication interface for accepting information from, or transmitting information to, the various gaming machines 20.

In one embodiment, the server 50 acts as a telecommunication controller, routing calls from remote locations to appropriate machines 20, or routing calls from machines 20 to outbound destinations. For example, in one embodiment, a phone number (or other unique identifier) is assigned to each gaming machine 20. Callers may attempt to call a player of a gaming machine 20 using the telephone number assigned to the machine 20. Such calls may be placed remotely and routed by the server 50 to the appropriate machine.

Similarly, calls maybe routed through the server 50 to outbound locations, such as a local exchange. For example, as illustrated, a communication link 52 maybe established between the gaming machine 20 and a remote telephone 54 via a wired telecommunication link. In addition, a link may be established with a wireless telephone 56, such as via one or more cellular, satellite or other links 58.

Of course, the server 50 (or other servers 50) maybe configured to perform a variety of tasks. For example, the server 50 may store player information and game play information, as known in the art of player tracking systems. In this regard, the server 50 may obtain information from the gaming machines 20 to track game play. The server 50 may also, as indicated above, generate game content for use by the gaming machine 20.

In one embodiment, a communication link is provided between each gaming machine 20 and the server 50. The links may be dedicated or shared. Further, multiple links may be provided for different purposes. For example, one link may be utilized to transmit player tracking/game play information. Another link may be utilized for the telecommunications. Yet another link might be utilized to transmit game information, such as where the game is controlled by the server.

The various links between the gaming machines 20 and the server 50 may be wired or wireless or combinations thereof. Communications maybe effected using a variety of hardware and software, and in accordance with a number of standards, such as IEEE-1394, IEEE802.xx or the like.

Figure 3:
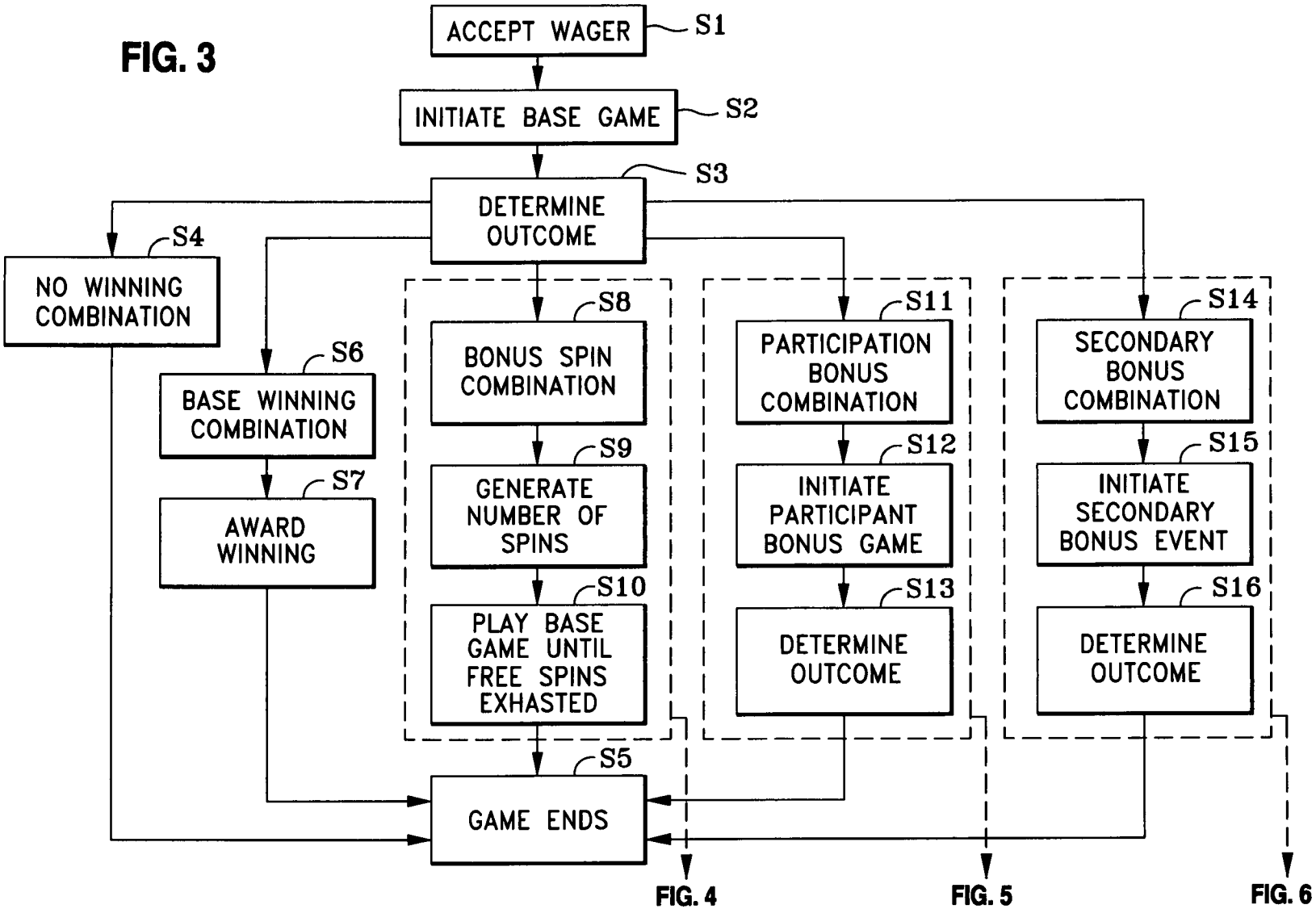
FIG. 3 is a flow-chart illustrating one embodiment of a method of playing a game in accordance with an embodiment of the invention.

One embodiment of a game of the invention will now be described with reference to FIG. 3. In a preferred embodiment, a game is presented as a wagering game. In such a configuration, a player wagers value for the opportunity to be awarded winnings. Of course, the game, or at least portions thereof, may be played for entertainment only, with the player not require to wager value.

In the wager format, as illustrated, in a step S1 the player places, and the gaming machine accepts, a wager. As described above, if the wager is in the form of monetary value, the wager may be placed in a variety of fashions. In one embodiment, a player inputs currency, coins or a medium representing or associated with such value, such as a coded ticket, credit/debit card or the like. The value may be credit to the machine 20, the player then placing a wager specifically for a game using the "bet" button 30. In that case, the number of credits belonging to the player is reduced by the amount of the bet.

In response to the wager, the game is then presented. In one embodiment, this step comprises the gaming machine 20 presenting a base game. In one embodiment, this game comprises the random selection of indicia, one or more of which, alone or in combination, comprise winning or losing game results. In the case of the gaming machine 20 described above, the base game comprises the rotation of the reels 24*a,b,c* to a stopped position in which they display a set of symbols or indicia. This set of indicia represents the outcome of the base game.

In one embodiment, if the indicia which appear in specific locations, such as along a payline 60, comprise a winning indicia or winning combination of indicia, then in a winning outcome is declared. As indicated below, there maybe a number of winning combinations, one or more of which trigger different outcomes or results.

In the embodiment illustrated, the game is presented on three reels 24*a,b,c*, each configured to display at least three symbols. There may be as few as one or multiple paylines. In the configuration illustrated, five paylines are illustrated.

In one configuration, the number of paylines which are activated is dependent upon the size of the player's wager. For example, if the player places a wager of a single amount, such as a single coin or credit, then a single payline may be activated. In that instance, only indicia appearing along that single payline are considered in determining the outcome of the game. Additional coins or credits wagered may activate additional paylines. A maximum bet, such as five coins or credits, may activate all of the paylines.

In one embodiment, symbols on reels are selected from one or more of the following:

TABLE 1

| | |
|---|---|
| A. | Dialing For Dollars logo |
| B. | Dialing For Dollars "Bonus Round" symbol |
| C. | Slot-A-Thon logo |
| D. | Slot Machine with TV type antennae coming out of the top |
| E. | Cellular phone |
| F. | Old style phone |
| G. | Modern phone |
| H. | Telephone variation #4 |
| I. | Telephone variation #5 |
| J. | Address Book |
| K. | Telephone Book |
| L. | Stop watch symbol |
| M. | "Make A Call" icon |
| N. | Phone booth or pay phone |
| O. | 911 symbol |
| P. | Operator |
| Q. | Phone card icon |
| R. | Prank call icon |
| S. | Can and a string symbol |
| T. | Wild symbol |
| U. | Multiplier type symbols |
| V. | Phone friends |
| W. | Slot-A-Thon bonus symbol |
| X. | Qualifier question symbol |

Preferably, of course, the symbol or symbols which comprise winning and losing combinations are known before the game begins.

In a step S3, the outcome of the base game is determined. In one embodiment, this comprises determining if the symbol or symbols along one more paylines are winning or losing combinations. As described above, in one embodiment, the outcome of the base game is known when the game is initiated, (such as by random generation of a number by the gaming controller (or a random number generator associated therewith), that number corresponding to a particular possible outcome), and before the reels are rotated or before they stop. In this configuration, the outcome of the game is known even before the reels stop spinning, and actually, the stopping position of the reels is determined by the then known outcome of the game.

The game may have a number of outcomes. As described below, in one embodiment, there are five possible outcomes. Of course, the game maybe played with varying types and numbers of possible outcomes.

In one embodiment, it maybe determined that the outcome is no winning symbol or combination of symbols (such as along an active payline), as in a step S4. In such event, the game may end, as in step S5. In a preferred embodiment, if there is no winning combination, the player loses their wager and they are paid no winnings.

In one embodiment, as in step S6, it may be determined that the outcome of the game is a particular winning symbol or combination of symbols comprising a base win. For example, one or more symbols or combinations of symbols may comprise a winning result which entitles the player to a winning. In such event, as in step S7, the player may be awarded a winning. The winning may be awarded in a variety of ways and may comprise a number of things.

In one embodiment, the winning comprises monetary value. The size of the winning may depend upon the size of the player's wager and/or the probable frequency of receiving the particular winning combinations, among other factors. In one embodiment, the winning is awarded to the player in the form of credits. The player may elect to "cash out" those credits from the machine, such as by requesting that a value ticket be printed by the printer 39, or by dispensing coins to the coin tray 36, among other ways. After the player is paid their winnings, the game preferably ends at step S5.

In one embodiment, as in step S8, it may be determined that the outcome of the game is a particular winning symbol or combination of symbols entitling the player to additional game play. In a preferred embodiment, the additional game play is offered to the player without additional wager.

Figure 4:
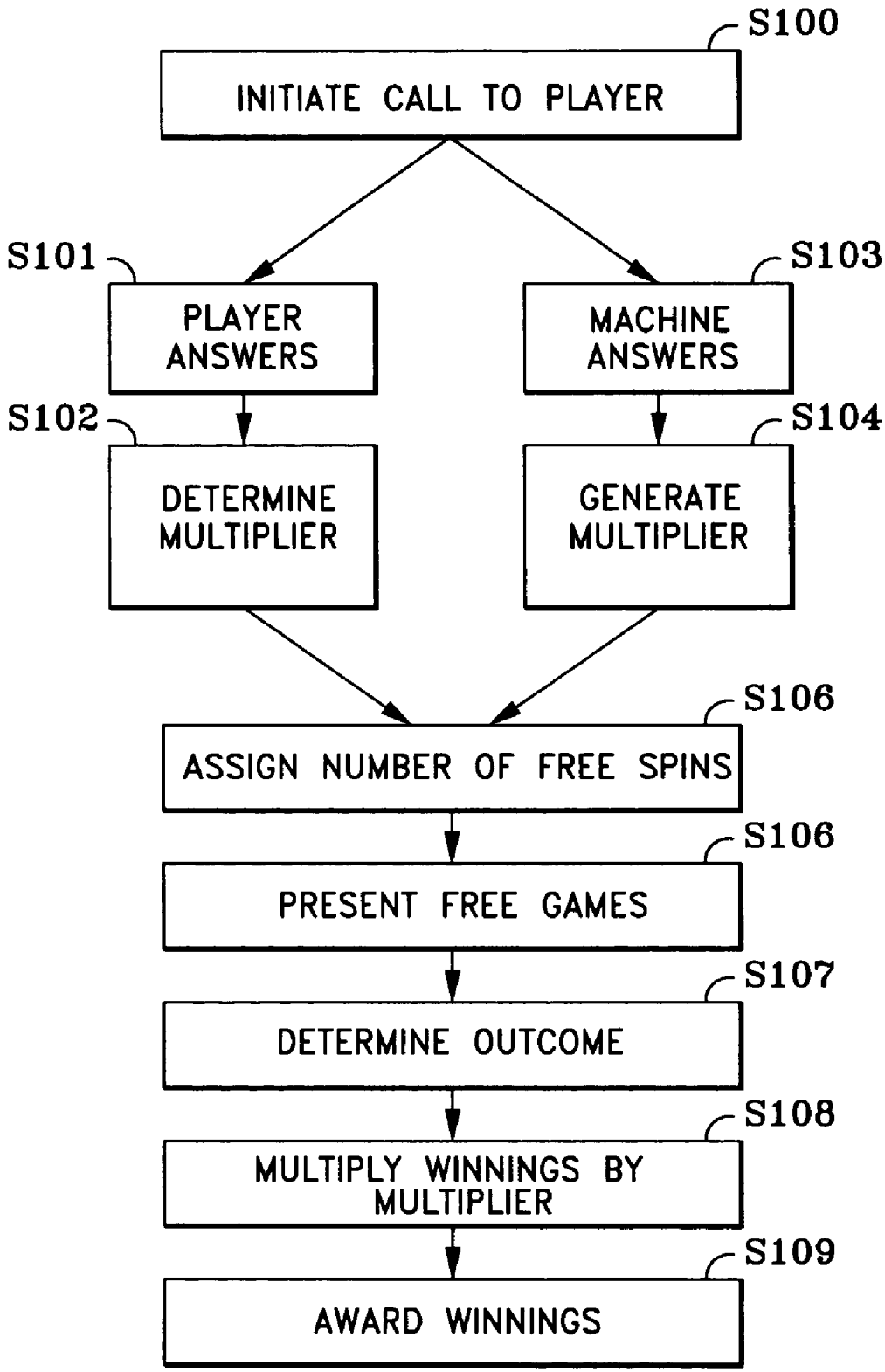
FIG. 4 is a flow-chart illustrating one embodiment of a bonus spin event of the method illustrated in FIG. 3.

Aspects of one embodiment of such a game are described in greater detail below in conjunction with FIG. 4. In one embodiment, as in step S9, the player is awarded the opportunity for a number of free game spins. The outcome of those games is determined and play continues until all of the free spins and associated events are completed, as in step S10. Of course, the result of those games may vary, and may include winning outcomes for which the player is awarded winnings. The game then ends at step S5.

In one embodiment, as in step S11, it maybe determined that the outcome of the game is a particular winning symbol or combination of symbols entitling the play to play a participant game. Aspects of one embodiment of such a game are described in greater detail below in conjunction with FIG. 5. In one embodiment, as in step S12, the bonus game is initiated. In step S13, the outcome of that game is determined. The outcome may be a winning or losing outcome, and may include awarding the player and/or third party participant winnings. In step S5, the game then ends.

In one embodiment, as in step S14, it maybe determined that the outcome of the game is a particular winning symbol or combination of symbols entitling the player to play a bonus event. Aspects of one embodiment of such a game are described in greater detail below in conjunction with FIG. 6. In one embodiment, as in a step S15, the bonus event is initiated or presented. In step S16, the outcome of that event is determined. The outcome maybe a winning or losing outcome, and may include awarding the player winnings. In a step S5, the game then ends.

A free spin bonus in accordance with the invention will now be described in conjunction with FIG. 4. As indicated above, such a bonus event may be initiated based upon a player receiving a particular symbol or combination of symbols, as in step S8 of the method of game play illustrated in FIG. 3.

In one embodiment, the free spin bonus offers the player the opportunity to win a number of free spins. The number of free spins awarded may vary, and may be as few as zero, but is preferably at least one and more preferably 5 to 25.

In one embodiment, this bonus event includes the step of determining the number of free spin games which the player is entitled to play, and then permitting the player to play those games. Referring to FIG. 4, in a step S100, a call is initiated to the player. In the case of the gaming machine 20 illustrated in FIG. 1, this step preferably comprises calling the player via the handset 40.

The call maybe initiated in a variety of ways. In a preferred embodiment, the controller of the gaming machine initiates the call, causing the player to be notified of an incoming call. This may include dissemination of an audible "ring," as is well known in the art of telephones. This may also include the display of information to the player, such as the display of a telephone and text indicating the player has an incoming call (such as displayed on display 38 of the gaming machine 20).

The player is provided the opportunity to answer the phone/take the call. In the configuration of the gaming machine 20 illustrated in FIG. 1, the player may answer the call by lifting the handset 40. Alternatively, the player may answer the call by pressing the "answer" button 32. Of course, the ways the player may take the call/answer the phone may depend upon the configuration of the gaming machine.

In one embodiment, a value is determined by how and when the call is answered. In one embodiment, in a step S101, the player may answer the call. Preferably, the longer the player waits to answer the call, the greater the value which is assigned. In a step S102, a multiplier value is set to the number of rings before the player answered the call. For example, the controller of the gaming machine may cause a ring to be generated at spaced intervals of 2 seconds. Once the player answers the call, the rings stop, and a multiplier is assign a value equal to the number of rings which were presented before the player answered the call. In other embodiments, the value could be a multiple of the number of rings, or the like.

In a step S103, the machine may answer the call automatically. In one embodiment, the gaming controller is configured to answer the call after a period of time if the player has not answered the call. In a step S104, in such event, a multiplier value is then generated or selected. The multiplier value may be selected randomly from a set of values. Preferably, the multiplier values which may be selected and assigned by the machine are less than that which the player has an opportunity to win. In one embodiment, the machine assigns a fixed multiplier of 2 for every event.

In this manner, the player must determine whether they wish to attempt to wait for additional rings in an attempt to obtain a higher multiplier, in light of the risk of the machine answering and assigning a lower multiplier. For example, a player who has waited three rings maybe entitled to a multiplier of 3. If the player waits for a fourth ring before answering, the player may either obtain the ring and then a multiplier of 4, or the machine may answer, causing the player's multiplier to be reduced to 2.

Next, a number of free spins are awarded, in step S105. In one embodiment, the gaming controller makes a selection of an outcome from possible selections. That selection is then transmitted to the player. In a preferred embodiment, the transmission of the selection is in the form of the call to the player. Preferably, the selection is presented in audible form to the player. Examples of possible calls and numbers of free spins assigned thereto are set forth below:

TABLE 2

| |
|---|
| 1. Wrong number - 5 free games |
| 2. I'll be late for dinner - 10 free games |
| 3. Your mother - 10 free games plus 2× more multiplier |
| 4. Best friend with gossip - 15 free games |
| 5. Radio Station promotion - 5 free games |
| 6. Prank call - 2 free games |

Now, the player is preferably provided the opportunity to play the games, as in step S106. As indicated, these games are preferably presented to the player without a requirement of an additional wager. In a preferred embodiment, the games which the player is allowed to play may either comprise the base game, as described above, or may be another game, such as presented on the video display of the gaming machine or presented by other reels or the like. For example, the player may be permitted to play a video slot game presented on the display 38 of the gaming machine 20 illustrated in FIG. 1.

In a step S107, the outcomes of the one or more games are determined. If the outcome of one or more of the games is a winning outcome, the player is preferably awarded winnings. In a step S108, any winnings are preferably multiplied by the multiplier value which was assigned or generated previously. For example, if in a free spin game the player obtained a winning combination having a payout of 20 credits and the player had obtained a multiplier of 3, then the player would be entitled to 60 credits. In a step S109, those winnings are awarded to the player.

As will be appreciated, to keep the free spin games simple, it is preferred that those games not involve bonus events themselves, but simply define winning or losing events. In other embodiments, the game may be more complex, with the player provided the opportunity to play bonus and other events, including further opportunity for additional free spin games or the like.

In one embodiment, the multiplier value for the event maybe posted to the player. For example, in the embodiment illustrated in FIG. 1, a multiplier value of 6× is shown. The multiplier value maybe displayed by a display of the machine 20 after it has been generated as part of the event. Likewise, the number of credits won by the player as part of the outcome of a game may be displayed. For example, if the player received a winning result having a 9 credit win, as multiplied by the multiplier (6), the player would be entitled to 45 credits, as illustrated. Of course, a credit meter may show the total number of credits which belong to the player from their value input, and wins/losses from the play of all games, including the bonus spins.

Figure 5:
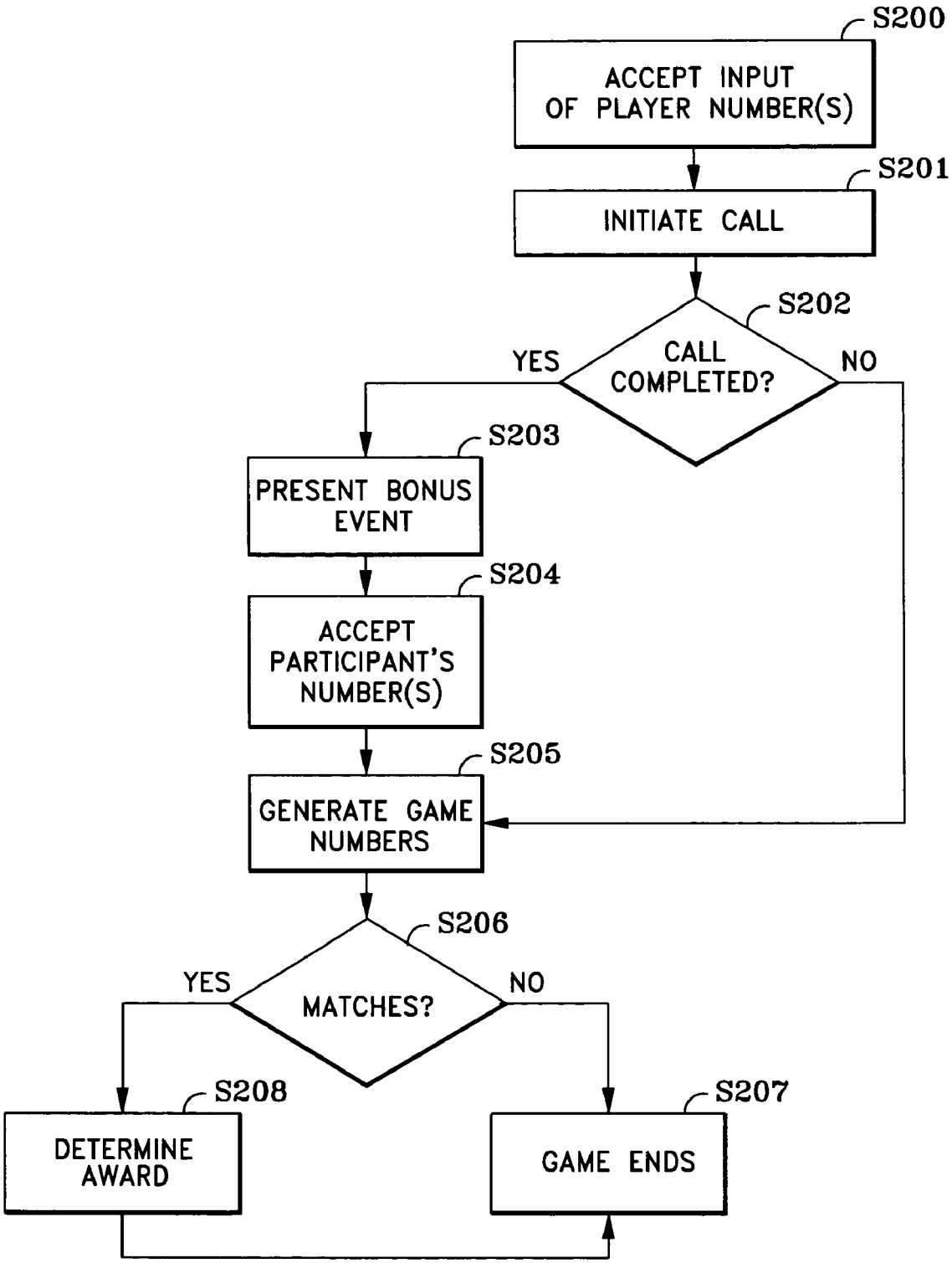
FIG. 5 is a flow-chart illustrating one embodiment of a third-party participant bonus event of the method illustrated in FIG. 4.

A participant bonus event in accordance with the invention will now be described in conjunction with FIG. 5. As indicated above, such a bonus event may be initiated based upon a player receiving a particular symbol or combination of symbols, as in step S11 of the method of game play illustrated in FIG. 3.

As one example, in the case of the symbol sets described above as used in the play of the base game, a set of any three "telephone" symbols on an active payline may initiate this bonus event. For reasons which will be apparent below, one embodiment of a bonus event maybe referred to as "phone-a-friend".

Initiation of the event may be accompanied by a notification at the gaming machine. For example, lights and sounds, along with audible or text information, may be presented to the player to make them aware that this bonus event has been triggered and to add excitement to the game, including excitement to passers-by and other players.

Preferably, this event offers the player the opportunity to play a game with another player or participant. In one embodiment, the game involves the calling of another participant or player.

In a step S200, a player inputs a player number. Preferably, this player number is used in the play of the bonus event. In the case of the gaming machine 20 illustrated in FIG. 1, the numbers may be input into the keypad 44. In one embodiment, the player number is a 5 digit number (e.g. 33554).

In a step S201, a call is initiated to a third party participant. This call may be initiated in a variety of ways. In one embodiment, the player is permitted to input a telephone number of a person they wish to have participate. For example, a person may input the phone number for their wife, mother, father, brother, sister, friend or the like. The phone number may be input using the keypad 44 in response to a prompt to the player to input the number.

In another embodiment, the call may be placed to a person identified in a player tracking system. A gaming operator may permit players to provide identifying information, including their telephone number. This information may be used, in part, to track the player's game play and reward them with awards for their play. In accordance with this embodiment, the information may be used to identify them as a participant in the bonus event. The player information, including the telephone number information, may be stored at a server (such as server 50 of the system illustrated in FIG. 2). When this bonus event is initiated, the gaming machine may contact the server and request a telephone number from the database. A player/telephone number may be randomly selected from the database and then transmitted to the gaming machine for initiating the call.

In yet another embodiment, a telephone number may be randomly generated by the gaming machine, and that number may be dialed in an attempt to form a link with a participant.

In one embodiment, a player may be permitted to select the way the call is placed (by input of a number of their choice, selection from identified participants in the database, or by random selection). In another embodiment, the manner by which the call is placed may randomly selected, and thus change from game to game.

In these embodiments, the telephone number is preferably utilized in an attempt to form a communication link with a participant. In the case of the system illustrated in FIG. 2, the call may be placed from the gaming machine 20 to another telecommunication device, such as a wired telephone 54 or wireless telephone 56. Essentially, the gaming machine 20 acts as a telecommunication device, in similar fashion to a normal telephone, permitting calls to be placed to other authorized telecommunication devices.

In one embodiment, calls may be placed to only "local" or toll-free locations. In other embodiments, calls may be placed to certain areas or locations, and in yet other embodiments, there may be essentially no restrictions upon calls.

In yet another embodiment, the call may be to a player at another gaming machine. In this embodiment, a call may be placed from one machine to another, either directly or via the server 48 or other device. In this embodiment, the gaming machines 20 do not necessarily need a communication link "to the outside", but simply need to be able to communicate with one another. In one embodiment, the call may be placed to a randomly selected machine, and in another embodiment, only to a machine at which a player is currently identified as playing.

In a step S202 it is determined if the call is completed. Generally, this involves determining if the call has been answered. In a step S203, if the call is completed, then in a step S204, a bonus event may be initiated. The bonus event may have several purposes. First, the bonus event may confirm the call has been answered by a participant, and not an answering machine or the like. Second, the bonus event may be used to determine criteria for the game.

First, the bonus event may include a requirement that the participant identify themselves. For example, in the case of a player selected from a player club database, the player may be prompted to enter their password, i.d., or other information which identifies them. Preferably, the information which is requested is information which is stored in the database and can thus be used to confirm the identity of the player. The player may speak, enter via their telephone touch-pad or otherwise provide the requested information, which is then checked against that in the database. If the information does not match, the player may not be permitted to play.

In a preferred embodiment, any player may play. The bonus event comprises the participant making a selection as an answer to a question. For example, the bonus event may comprise asking a multiple-choice question having several answers. In one embodiment, no answer is wrong, but the selection of an answer corresponds to a multiplier or other bonus event value. For example, the player may be asked a question and then be presented with optional answers A, B, C, or D, or 1, 2, 3, or 4. The player may use their keypad or voice to make a selection of an answer.

In one embodiment, the bonus question is generated by the gaming machine, server or the like, and the information is transmitted to the participant over the telecommunication link once the call is answered. When the call is answered, the participant may also be played a greeting, such as "you have been selected to participate in the phone-a-friend game and you now have the opportunity to win thousands of dollars". In one embodiment, where the player is permitted to select the participant, the player may be permitted to identify themselves to their friend to entice them to play.

As indicated, in a preferred embodiment, each answer is associated with a bonus event value. In one embodiment, the value is a winning value multiplier, such as 2×, 4× or the like.

In a step S204 input is received regarding the participant's numbers. In similar fashion to the player's numbers, the participant is preferably permitted to select a lucky number, such as a five digit number. Of course, the participant number could include more or less digits than the player number.

In a step S205, game numbers are generated. Preferably, the game numbers comprise a first number the same size as the player's number, and a second number the same size as the participant's number. For example, if the player and participant numbers comprised five digit numbers, then so do the game numbers.

If the call is not completed or if the call is completed but the participant's identification is not confirmed, the game may continue without participation by the third party. In such event, the game preferably continues at step S205 as well, except that only one game number is generated corresponding to the player. Alternatively, other events may be presented to the player, including events which offer a much lower or smaller jackpot/winning.

In a step S206, it is determined if the player's number match the game numbers, and/or if the participant's numbers match the corresponding game numbers. For example, the first game number is compared to the player's number to see if they match. The second game number is compared to the participant's number to see if they match.

In a step S207, if neither sets of numbers matched, then the game preferably ends.

In a step S208, if either or both of the sets of numbers matched, then an award may be determined and be awarded. For example, in one embodiment, if just the player's number matched the corresponding game number, then the player may be awarded a monetary win, such as $1000.00. If only the participant's number matched the corresponding game number, then the participant may be awarded a monetary win, such as $1000.00. If both the player and participant numbers matched the corresponding numbers, then the player may be awarded a large jackpot award, such as $1,000,000.00, and the participant might not participate in an award.

Of course a variety of awards may be yielded as a result of matching numbers. In one embodiment, a player and/or a participant may be awarded a win if some but not all of the digits of their numbers matched the corresponding game numbers. For example, if the player selected 45897 and the game number for the player was 45896, the player might be awarded an award comprising some portion of the top award.

In one embodiment, the award which is paid to the player or participant (other than the jackpot award), may be multiplied by the multiplier value which was yielded as part of the participant's play (in step S203). For example, if the participant's numbers matched and the multiplier generated earlier was of the 2×, then the player might be paid $2000.00 (i.e. 2×$1000.00).

Of course a variety of variations of the game are contemplated. Preferably, the bonus event includes the step of forming, or attempting to form, a communication link with a third party. However, the exact form of the game which is played in association with that event may vary. For example, where the third party participant is at another gaming machine, both gaming machines may immediately go into a bonus mode which presents to both players the opportunity to play a game of video poker against one another, or against the house, in an attempt to win a game. Alternatively, both players may be presented with a slot type game which they play in an attempt to obtain a winning result. A primary advantage, regardless of the particular type of game which is presented/played, is the possibility for, if not the actual participation of, the third party with the player in the event. As described below, this adds a great dimension of excitement to the game.

As one aspect of the bonus event, rules or laws may permit participation of only players of certain ages or in certain geographic locations. Part of the play of the event may require confirmation that the participant is eligible to participate. In the case of participants who are selected from a player club database, as indicated above, the confirmation of the identity of the participant may be sufficient (and where the eligibility of the participant to play is confirm at the time they sign up to participate). In other embodiments, additional information may be obtained to confirm eligibility.

A secondary bonus event in accordance with the invention will now be described in conjunction with FIG. 6. As indicated above, such a bonus event may be initiated based upon a player receiving a particular symbol or combination of symbols, as in step S14 of the method of game play illustrated in FIG. 3.

As one example, in the case of the symbol sets described above as used in the play of the base game, a set of any three "slot-a-thon" symbols on an active payline may initiate this bonus event. Once again, when this bonus event is activated, audible and/or visible information of such may be presented to the player to make them aware of the event and to add excitement to the game.

Figure 6:
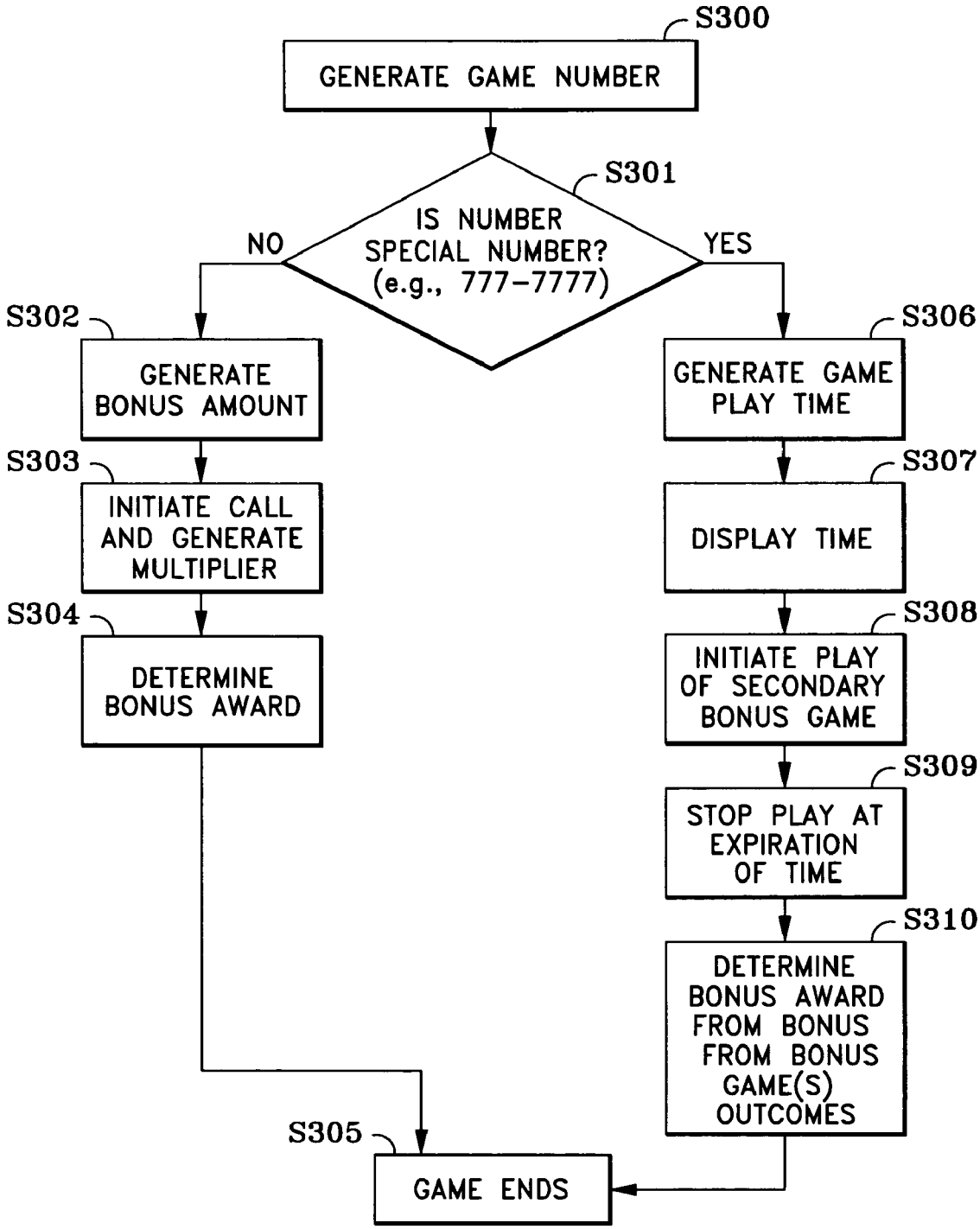
FIG. 6 is a flow-chart illustrating one embodiment of a secondary bonus event of the method illustrated in FIG. 4.

In one embodiment, the bonus event initiates with the generation and display of a game number, as in step S300 of FIG. 6. In one embodiment, the game number is a 7 digit number which is randomly generated. The game number is preferably displayed by the gaming machine, such as using the video display 38 thereof. In one embodiment, the number is displayed as the result of the simulated spin of seven (7) video reels each having a single position. In one embodiment, the "spinning" of the video reels is initiated by the player, such as by the player using the "spin" button 28 of the gaming machine.

In a step S301 it is determined if the generated number is a predetermined number, such as 777-7777. If not, then the bonus event continues in a step S304, the game number is utilized to create a bonus amount. In one embodiment, the digits of the number are added to create a value. For example, the game number 555-1212=21. This value would be assigned as a bonus value in the bonus event. In one embodiment, the bonus value is posted to the player, such as by display on the video display or other display of the gaming machine.

In a step S303, the player is preferably provided the opportunity to increase the size of the bonus value. In one embodiment, the player plays for a multiplier value.

In one embodiment, the event is configured as a telephone call. Various events may be utilized to determine the multiplier value, such as a number of rings (in similar fashion to that described above), or the player might place a call to third party (either via a number of their choice or a preselected number, as described above) and the third party might answer a question having answers with associated multiplier values, or a call might be initiated to a player of another gaming machine who then engages in an event, such as the selection of a number or other event. Multiplier values might be displayed by the gaming machine and the player might utilize the telephone to stop a pointer or the like upon a particular value (such as by the player lifting the handset, dialing a number or the like). Of course, other events might be utilized to determine the multiplier value. It is preferred, however, that the event be a telecommunication-related event, as that substantially increases the excitement of the game.

Based upon the outcome of the event, the multiplier value is determined. In a step S304 the total bonus event award is determined. For example, if the player's starting bonus value was 21 and they obtained a multiplier value of 5×, the player would win 105 credits/coins or other value. That winning would preferably be awarded to the player, such as in the form of credits at the gaming machine. In a step S305, the game then ends.

In step S301 if it was determined that the game number comprised the special or particular number, then a different event is preferably presented to the player. In one embodiment, the player is provided the opportunity to play a special game for the opportunity for winnings. Preferably, the player is allowed to play the game with no additional wager necessary.

In one embodiment, in a step S306, a game play time is initiated. In one embodiment, the game play time may be fixed. In other embodiments it may be randomly selected or determined through some secondary event. Preferably, the total time of the event and the time remaining in the event are displayed to the player, as in step S307. In the case of an embodiment of a gaming machine, such as illustrated in FIG. 1, the gaming machine 20 may include a timer 60. The timer 60 may be a digital display, mechanical timer or the like. As illustrated, the timer is located in a top box portion of the gaming machine, but is could be located elsewhere. In addition, the time information could simply be displayed on another display (such as display 38) of the gaming machine.

Preferably, the event starts at a step S308, with the timer displaying remaining time as the time of the event expires. In one embodiment, the event is the play of a video slot game presented on a display of the gaming machine, such as display 38 of the gaming machine 20 illustrated in FIG. 1.

For example, the game may comprise a five (5) reel, nine (9) payline video slot machine which traditional symbols. Such games are well known in the art. Preferably, during the active time period, the player may press the "spin" button to initiate the game. The outcome of each spin is determined to see if the result was a win or loss. Preferably, certain symbols or combinations thereof when occurring along one of the paylines, is deemed a winning combination, as is known in the art. In one embodiment, at least one set of symbols along a payline results in the award of a jackpot amount, such as $1,000,000.00. For example, one set of symbols on the reels may comprise "Slot-A-Thon" symbols, and a set of those symbols on all reels along a payline, may trigger the jackpot winning amount.

Game play ends in a step S309 when the time expires. In a step S310, the total bonus award is determined and awarded to the player. For example, a player might play 14 games, with 5 of the games yielding winning combinations with associated winning values of 10, 100, 400, 5 and 20, for a total winning of 535 during the event. After the bonus award is paid to the player, the game ends in step S310.

Of course, the invention may have various forms and configurations. The base game of the invention may have a variety of other forms than as described above. The base game could comprise a video slot game, and could even comprise other games such as video poker, electronic bingo or the like.

The game of the invention need not include all of the game play variations described. For example, the game may only include the base game and one of the bonus events, such as either a free spin bonus or participant bonus.

In one embodiment, the bonus events of the invention may be configured as stand-alone games or base games themselves having bonus events. For example, the participant bonus could itself comprise a base game. In one such configuration, a player might be required to place a wager, and would then be allowed to input their player numbers and attempt to call a participant.

The games of the invention may be presented at a variety of gaming machines or systems other than that described in conjunction with FIGS. 1 and 2. For example, the games could be presented in a mobile gaming environment, such as on cellular phones. For example, a player might utilize their cellular phone to communicate with a game server. In the event a base game is a winning event triggering a participant bonus, the server or player might be permitted to call another participant (for example, the server might place the call and link the player and participant in "conference" call type fashion).

In another embodiment the games of the invention may be implemented in an on-line format, such as from home or work computers. Once again, the player may connect to a server gaming device, such as over the Internet. Game play may then proceed as described.

In these latter embodiments, it will be appreciated that software or game code may be required to be installed or loaded onto the device to enable play of the game. Such software may be downloaded to those devices or be permanently loaded into a memory thereof when they are manufactured or the like.

In one embodiment, the games of the invention may be played as "skill" games. For example, a player may or may not be required to place a wager. The player may then play for points. A player obtaining certain numbers of points (or a participant who does so via the participant portion of the game) may be entitled to prizes, such as gift certificates and goods. Such a variation of the game has particular applicability to on-line and wireless environment presentations.

As indicated, the gaming machine or other device which is utilized to present the game is or includes a telecommunication device. As described above, in one embodiment a gaming machine may incorporate such a device. The device may include a handset, speaker-phone, headset or other device for transmitting audible information to the player and permitting the player to answer and/or initiate calls. Of course a wide variety of other devices may be utilized. A gaming machine might include a wireless or "hand-held" phone unit, rather than a wired handset. In one embodiment, as indicated, the telecommunication device may be entirely "internal" to the machine. The image of a telephone or the like may be displayed when a call is to be placed or is incoming and needs to be answered. The player may utilize buttons or other inputs to answer and place calls.

As also indicate, the gaming machine or other device via which the game is presented may vary. As indicated, the machine may have a traditional "gaming machine" style or configuration. The various methods, including the games, may be presented in other environments, such as in a distributed environment. For example, the games may be implemented as "Internet" games. In one embodiment, a player may contact a game host, such as via computer via a communication link such as the Internet.

In one embodiment communication with the third party participant may take other forms. For example, in an "Internet" or similar environment, calls may be effected via the Internet, such as by a standard telecommunication-type call to a telephone or another party's computer, and by other means, such as an Instant Messenger™ message, email message or the like, by which a third party may participate.

In one embodiment, various aspects of the invention may be implemented as an additional system or device to an existing gaming machine. For example, a gaming machine may be configured to present a main or base game. A communication device may be associated with the gaming machine, but not be directly integrated therewith. For example, a communication device may include a display, handset or the like which is physically associated with (connected or mounted thereto, or located proximate the machine), that device forming a part of a "bonus system," such as by being connected to a bonus server which communicates with the gaming machine. In this configuration, a bonus "system" is essentially associated with a generally separate gaming system including gaming machines.

It will be appreciated that the odds of obtaining winning combinations of the main or base game, the odds of triggering a bonus event, the odds or winning a bonus event, and the payouts, may vary. In one embodiment, the wager or bet which is placed is used to fund payouts for all portions of the game. Thus, the total payout for the base game may be relatively low, in order to fund large jackpots for the bonus/secondary events.

In one embodiment, participation in the bonus events, or at least the opportunity to win jackpots, may be tied to the player's placing a large or maximum bet. In one embodiment, the largest jackpots or awards may be configured as progressive awards. In such an arrangement, the size of the jackpot grows (based on bets placed at one or more machines) between periods when it is won. The jackpot may have a minimum funding amount, or may drop to zero when won.

The game could involve the play of more than one participant. For example, the game could be configured so that more than one third party participant is called and may participate in the game. In another embodiment, multiple opportunities may be provided to form a call with a participant. For example, if a player enters their friends phone number and the call is not answered, the player may be provided one or more additional opportunities to place additional calls, or the gaming machine may similarly be configured to attempt to complete such a call.

It will be appreciated that the methods of the invention are exemplary and the various steps may be changed, including their order. For example, instead of determining the results of a set of games in a free spin bonus, the result of each game are essentially determined or known at the end of each game. Further, various of the features of the various bonus events may apply to one another or be incorporated therein, or be incorporated in entirely different games.

The gaming machine, system and games of the invention have a number of advantages.

One aspect of the invention is a game, and more particularly a wagering type gaming offering the chance for monetary winnings, which has the opportunity to involve a participant. This aspect of the game adds significant excitement to the game. First, the player may be offered the opportunity to select their "friend" to play the game, building comradery and the like. Second, the player does not known if the call will be completed. If completed, the player and participant engage in a bonus event providing them an opportunity for significant winnings.

Another aspect of the game is a game which includes telephone or telecommunication calls to or from the player. The use of a telephone or telecommunication link adds excitement and a new dimension to game play, which traditionally relies upon simple viewing of the gaming machine itself. In the games of the invention, the player must interact with the gaming machine to place and/or answer the telephone/calls.

As indicated, in one embodiment, the possible participant in the bonus game may be selected from a player club database. One aspect of the invention is thus a system including a database of player information including player telephone numbers. In one embodiment, the database may include additional information such as player identification information for player verification purposes. As part of the system, players who sign up for the club are randomly selected (or their telephone numbers are), entitling them a chance to participate in the game.

In this regard, players are enticed to sign up for the player club for the opportunity to participate in the game. As is known, casinos and other entities find very valuable the ability to identify and track players, as such is a marketing tool which they can utilize to attract and keep players. In accordance with the invention, a valuable means is provided to entice players to sign up for the club.

In an embodiment where the game involves calling a player of another gaming machine, participation in the club/tracking system may be further enhanced where only players who are "logged in" may be identified as potential participants in the game.

Another embodiment of the invention is a game which offers a plurality of different bonus or secondary events. Because of the variety of bonus events, the play of the game is not repetitive, and instead remains exciting to the player.

Various of the features of the invention have been described as "bonus events." The events are referred to as a "bonus event" primarily because they offer play and/or a win opportunity which differs from the base game or event itself. However, the bonus events may be considered in one or more embodiments as essentially being a part of the base event, but just comprising one of the potential variations of game play of the base game or event, rather than events separate therefrom, since in a preferred embodiment the bonus events are triggered by outcomes of the play of the bonus event.

Another aspect of the invention is an event, and preferably a bonus game or event, which has occurs or is enabled for play during a particular time interval. As indicated, a bonus event may be initiated at a start time and end after a period of time. The duration of the bonus event might be fixed, or might vary, such as randomly or based upon various criteria, such as the result of the main game which triggered the bonus event, the player's wager or the like. In one embodiment, a timer is associated with the event for displaying remaining play time.

Another aspect of the game is that, even aside from the participant bonus, the game (including bonus or second events), offer a great deal of player participation. For example, compared to a simple wheel spin as a bonus event, the bonus events of the invention involve answering calls, making decisions regarding when to answer calls, playing games during time periods, and making number selections.

One aspect of the invention is the ability to involve a participant regardless of their location. The game offers the ability of a participant to play via a cellular phone, land line or other telecommunication link (including computer telecommunication link, such as the Internet), essentially enabling them to be anywhere to participate in the game.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of playing a game at a gaming machine comprising the steps of:

presenting a base game to a first player, said base game having a plurality of possible outcomes, at least one of which is a bonus event initiating outcome;

determining the outcome of said base game, and if said outcome is said bonus event initiating outcome, initiating a bonus event comprising the steps of:

attempting to form a communication link between said gaming machine and a communication device of a secondary player located remote from said gaming machine;

if said communication link is formed, presenting a bonus game involving input from said secondary player, said bonus game comprising accepting input from said secondary player of a number, generating a first game number and determining if said secondary player number and first game number match; and determining the outcome of said bonus game.

2. The method in accordance with claim 1 wherein said bonus game also comprises accepting input from said first player of a player number, generating a second game number and determining if said first player number and said second game number match.

3. The method in accordance with claim 1 wherein, if said communication link is not formed, said bonus event comprises accepting input from said first player of a player number, generating a game number and determining if said player number and said game number match.

4. The method in accordance with claim 1 wherein said step of attempting to form a communication link comprises accepting input of a telephone number from said first player and attempting to call said telephone number.

5. The method in accordance with claim 1 wherein said step of attempting to form a communication link comprises selecting a telephone number from a database and attempting to call said telephone number.

6. The method in accordance with claim 5 wherein said database comprises a database of player information including information identifying players and including their telephone numbers.

7. The method in accordance with claim 1 wherein said base game comprises a slot game in which a plurality of symbols are displayed in one or more rows and columns.

8. A method of playing a game presented by a gaming machine comprising:

presenting a base game, said base game having a plurality of outcomes, at least one of said outcomes comprising a bonus event initiating outcome;

determining the outcome of said base game and, if said outcome is said bonus event initiating outcome, presenting a bonus event comprising the steps of:

initiating a call to the player of said gaming machine, including generating audible ring indicators;

determining a multiplier value depending upon whether said player answers said call or said call is answered automatically;

presenting at least one bonus game, each bonus game having a plurality of outcomes, at least one of which is a winning outcome having an associated payout; and increasing the payout associated with said at least one bonus game by said multiplier.

9. The method in accordance with claim 8 wherein said multiplier comprises the number of audible rings before said player answers, if said player answers.

10. The method in accordance with claim 8 wherein said multiplier is a pre-set number if said call is answered automatically.

11. The method in accordance with claim 8 wherein said at least one bonus game comprises a slot type game in which a plurality of symbols are displayed in one or more rows and columns.

12. A system configured to present a game to a player comprising:

at least one server, said server including a database of information including the telephone numbers of one or more parties;

at least one gaming machine, said gaming machine including at least one display configured to display game information to a player, at least one input for accepting input from a player, and at least one controller configured to control the operation of said gaming machine, said gaming machine including at least one telecommunication device, said telecommunication device configured to be activated based upon the result of at least one game presented by said gaming machine, the gaming machine configured to utilize one or more of the telephone numbers in said database in an attempt to establish telecommunication links using said telecommunication device, if said telecommunication link is formed, presenting a bonus game involving input from at least one additional player, said additional player remotely located away from said gaming machine, and wherein bonus game includes receiving input from said additional player, said input at least in part determining the outcome of said bonus game.

13. The system in accordance with claim 12 wherein said telecommunication device includes a handset.

14. The system in accordance with claim 12 wherein said gaming machine includes a plurality of reels configured to display game indicia used in a base game, and said display configured to display information associated with a bonus event.

15. The system in accordance with claim 14 wherein said telecommunication device is configured to be activated upon receiving a bonus event initiating outcome of said base game.

16. A method of playing a game at a gaming machine comprising the steps of:

presenting a base game to a first player, said base game having a plurality of possible outcomes, at least one of which is a bonus event initiating outcome;

determining the outcome of said base game, and if said outcome is said bonus event initiating outcome, initiating a bonus event comprising the steps of:

attempting to form a communication link between said gaming machine and a communication device of a secondary player located remote from said gaming machine by accepting input of a telephone number from said first player and attempting to call said telephone number;

if said communication link is formed, presenting a bonus game involving input from said secondary player; and determining the outcome of said bonus game.

17. The method in accordance with claim 16 wherein said bonus game comprises accepting input from said secondary player of a number, generating a first game number and determining if said secondary player number and first game number match.

18. A method of playing a game at a gaming machine comprising the steps of:

presenting a base game to a first player, said base game having a plurality of possible outcomes, at least one of which is a bonus event initiating outcome;

determining the outcome of said base game, and if said outcome is said bonus event initiating outcome, initiating a bonus event comprising the steps of:

attempting to form a communication link between said gaming machine and a communication device of a secondary player located remote from said gaming machine by selecting a telephone number from a database and attempting to call said telephone number;

if said communication link is formed, presenting a bonus game involving input from said secondary player; and determining the outcome of said bonus game.

19. The method in accordance with claim 18 wherein said bonus game comprises accepting input from said secondary player of a number, generating a first game number and determining if said secondary player number and first game number match.

20. The method in accordance with claim 19 wherein said database comprises a database of player information including information identifying players and including their telephone numbers.

21. A method of playing a game at a gaming machine comprising the steps of:

presenting a base game to a first player, said base game having a plurality of possible outcomes, at least one of which is a bonus event initiating outcome;

determining the outcome of said base game, and if said outcome is said bonus event initiating outcome, initiating a bonus event comprising the steps of:

attempting to form a communication link between said gaming machine and a communication device of a secondary player located remote from said gaming machine;

if said communication link is formed, presenting a bonus game involving input from said secondary player, said bonus game comprising accepting a first indicia from said secondary player, generating a game indicia and determining if said first indicia and said game indicia match; and determining the outcome of said bonus game.

22. The method in accordance with claim 21 wherein said first indicia comprises a number.

23. The method in accordance with claim 21 wherein said first indicia comprises an answer to a question.

24. The method in accordance with claim 21 wherein said outcome of said bonus game is declared a winning outcome if said first indicia and said game indicia match.

25. The method in accordance with claim 21 including the step of awarding an award if said outcome of said bonus game is winning.

26. The method in accordance with claim 25 wherein said award comprises a multiplier of a base award.

27. The method in accordance with claim 21 wherein said game indicia is generated by said first player.

* * * * *